United States Patent [19]

Sakai et al.

[11] Patent Number: 4,583,560

[45] Date of Patent: Apr. 22, 1986

[54] TOBACCO SMOKE FILTER

[75] Inventors: Takashi Sakai, Toyama; Kazuo Maeda; Masuo Kawabata, both of Kanagawa; Mituo Kono, Tokyo, all of Japan

[73] Assignees: Mitsubishi Acetate Co., Ltd; Japan Tobacco Inc., both of Tokyo, Japan

[21] Appl. No.: 511,688

[22] Filed: Jul. 7, 1983

[30] Foreign Application Priority Data

Jul. 7, 1982 [JP] Japan ..... 57-116826

[51] Int. Cl.[4] ..... A24D 3/04; B34C 5/00

[52] U.S. Cl. ..... 131/336; 131/338; 131/339; 131/344; 493/39; 493/42; 493/47; 493/50

[58] Field of Search ..... 131/336, 338, 339, 340, 131/344

[56] References Cited

U.S. PATENT DOCUMENTS 3,490,461 1/1970 Osmalov et al. ..... 131/336

*Primary Examiner*—V. Millin

*Attorney, Agent, or Firm*—Sughrue, Mion, Zinn, Macpeak and Seas

[57] ABSTRACT

A tobacco smoke filter includes a corrugated tape-like wrapping which, together with an outer perforated or otherwise air-permeable paper, defines a set of longitudinal grooves. Each of the grooves includes a blocking member, so as to inhibit direct smoke flow through the grooves and promote a ventilation effect. The blocking members in each groove are longitudinally staggered from one groove to the next to simplify the production of the device.

21 Claims, 12 Drawing Figures

FIG. 4
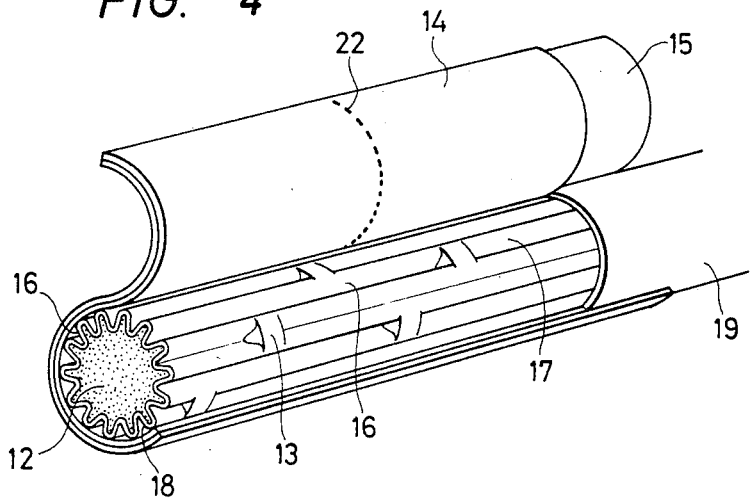
FIG. 5
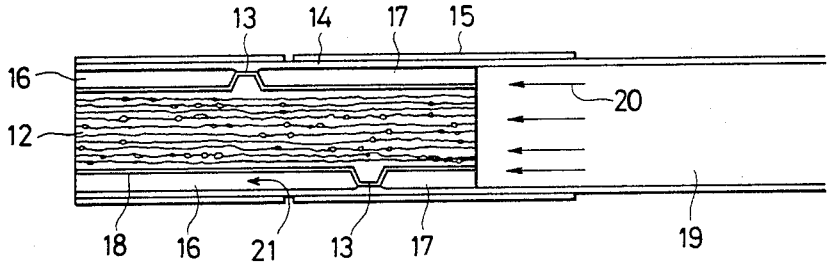
FIG. 6(a)
FIG. 6(b)
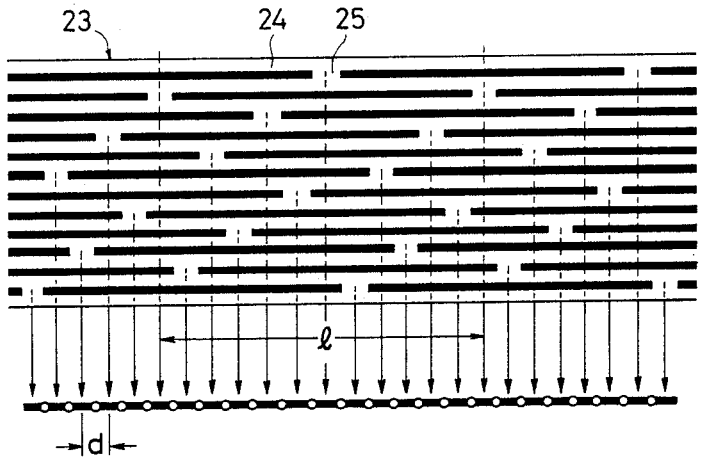

TOBACCO SMOKE FILTER

BACKGROUND OF THE INVENTION

1. Technical Field

The present invention relates to a tobacco filter having a ventilation effect. More specifically, the present invention relates to a tobacco filter which during smoking permits only external air to be guided through grooves around the filter core and prevents therethrough a substantial flow of tobacco smoke. This filter has small inhalation drag and the smoker can enjoy the feeling of ample smoke despite the smallness of the actual amount of smoke components being inhaled. In addition, the filter is capable of removing undesirable gaseous vapor components in the tobacco smoke.

2. Background Art

With the recent change in consumer's preferences toward "milder" tobacco, active R & D efforts are being made to develop tobacco smoke filters suitable for this purpose. The main aim of these efforts is directed to the development of filters capable of effective removal of components in the smoke particles such as tar and nicotine. Several methods have been proposed for attaining this object: one is by filling a single filter with an increased quantity of filter material, and another is by increasing the area of contact between the components in the smoke particles and the filter material during smoking by means of increasing the fineness of the filter material or by using a filter material with a profiled cross section. But the smoker is unable to enjoy smoking with the tobacco smoke filters made by these methods because they cause increased inhalation drag during smoking. A tobacco smoke filter free from this defect is described in U.S. Pat. No. 4,007,745. This filter is made of a thermally formed filter material having an embossed pattern. This filter is filled with an increased amount of filter material, but does not cause a corresponding increase in inhalation drag during smoking, and in addition, it is effective for removing components of the smoke particles. However, this filter is relatively ineffective in removing gaseous vapor components in tobacco smoke and does not present the smoker with the feeling of ample smoke inhalation.

Attempts are being made to develop materials for tobacco filters that are free from these defects. Japanese Patent Publication No. 31948/1981 (FR No. 2,373,975) discloses a tobacco smoke filter which, as shown in FIG. 1, comprises a filter core (1) wrapped with a corrugated tape (2) having a flat portion (3). An outermost layer of air-permeable paper (4) cooperates with the corrugated tape to define grooves through which external air that has penetrated the air-permeable paper is guided. This filter can be produced by a machine shown diagrammatically in FIG. 3. A sheet of paper (5) is fed through corrugation rolls (6) to form a sheet of corrugated paper having grooves (7) and flat portions (8) as shown in FIG. 2. The corrugated paper is wrapped around a filter tow (9), and then wrapped with a sheet of air-permeable paper (10). The resulting assembly is divided by a cutter (11) into a plurality of tobacco smoke filters each having the construction shown in FIG. 1. One defect with this method is that it is very difficult to cut the filter exactly at the very small flat portions (8) formed on the corrugated paper, and this difficulty must be eliminated before the method can be put to commercial use.

SUMMARY OF THE INVENTION

In view of this situation, we have made various efforts to develop a tobacco smoke filter that gives the smoker the smallness of inhalation drag, the feeling of ample smoke inhalation and the impression of "mildness" and that further has the ability to remove the proper amount of particulate smoke components and gaseous vapor components of tobacco smoke. Our efforts have also been directed to the development of a commercial method of producing such a tobacco smoke filter.

The essence of the tobacco smoke filter of the present invention is shown in the perspective and partially cutaway view of FIG. 4. The filter comprises a core made of a filter material (12) wrapped with substantially one turn of a corrugated tape-like material having grooves, each being provided with at least one blocking member (13) in a longitudinal direction and positioned in such a manner that the blocking member in one groove is staggered with respect to that in adjacent grooves. Either a sheet of air-permeable paper (14), or a sheet of perforated connecting paper (15), or both, are wrapped around the corrugated tape so that they cooperate with the tape to define the groove spaces (16) and (17) which extend in the axial direction of the filter and are separated from each other by the blocking member (13).

The present invention also provides a tobacco smoke filter which, in addition to the features described above, has a tubular member (33) that penetrates the center of the filter as shown in FIG. 7, or a tube that partially penetrates the center of the filter as shown in FIGS. 8 or 9.

The present invention further provides a tobacco smoke filter which, as shown in FIGS. 10 or 12, has a dual structure comprising a filter having the features shown in FIG. 4 and another filter made of conventional fibrous filter materials or those with additives. As shown in FIG. 11, the invention also provides a tobacco smoke filter which, in addition to the features shown in FIG. 4, has a solid additive incorporated in the central area of the filter.

BRIEF DESCRIPTION OF THE DRAWINGS

FIG. 4 is a perspective and partially cutaway view of one embodiment of the tobacco smoke filter of the present invention;

FIG. 5 is a cross section of the filter of FIG. 4;

FIG. 6 is a plan view of one embodiment of the corrugated tape-like material used in preparing the tobacco smoke filter of the present invention.

DETAILED DESCRIPTION OF THE PREFERRED EMBODIMENTS

Figure 1:
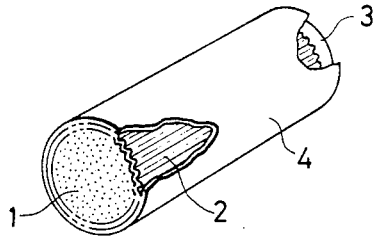
FIG. 1 PRIOR ART
FIG. 1 is a perspective view of a conventional tobacco smoke filter having a ventilation effect.
Figure 2:
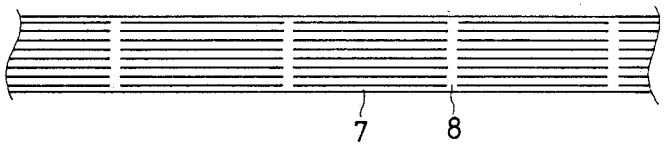
FIG. 2 is a plan view of a corrugated tape-like material used in the filter of FIG. 1.

FIG. 5 shows one embodiment of the tobacco smoke filter of the present invention as connected to a tobacco cylinder (19). When tobacco smoke flowing through the cylinder (19) in the direction indicated by the arrows (20) reaches the filter, it is blocked by the members (13) and is unable to pass all the way through the grooves (16), and instead it is filtered by the core material (12). The outermost layer of the smoke filter of the present invention is made of a sheet of air-permeable paper (14) or perforated connecting paper (15), and in addition, the grooves (16) and (17) separated from each other by the blocking members (13) are distributed in suitable proportions. For these two reasons, when the smoker inhales, atmospheric air (21) comes into his mouth through the grooves (16), and, in comparison with conventional smoke filters, the filter of the present invention is capable of sufficient removal of particulate smoke components without causing two disagreeable effects, i.e., increased inhalation drag and the feeling of reduced smoke.

The grooves (16) are separated from the grooves (17) by the blocking members (13) and extend toward the end of the filter tip opposite the tobacco cylinder, and they are fed with atmospheric air taken in through holes such as those indicated by (22) in FIG. 4. This air does not dilute the tobacco smoke and instead it is directly fed to the smoker's mouth without being heated by the smoke. This ventilating effect of the grooves (16) is so great that the filter of the present invention gives the smoker a better chance of enjoying smoking and further reduces the amount of gaseous vapor components of the smoke. The grooves (17) extending toward the cylinder side also serve as channels through which gaseous vapor components made of very small particles diffuse themselves between each puff.

An important feature of the tobacco smoke filter of the present invention lies in the corrugated tape-like material thereof and its unique structure, and a plan view of a typical example of this corrugated tape is shown in FIG. 6(*a*). Numeral (23) indicates an unrolled tape which is to be wrapped around the filter core, (24) indicates a plurality of grooves formed in the tape, and (25) represents a plurality of blocking members positioned at generally equal distances along each groove. The symbol (l) indicates the length of a unit tape that is to be wrapped around a single filter tip.

Unlike the conventional smoke filters having the ventilation effect, the blocking members (25) are positioned along the grooves in the longitudinal direction of the filter of the present invention in such a manner that the blocking member in one groove is staggered with respect to the blocking member in other grooves. This means that if the blocking members are arranged in one line in a direction perpendicular to the axis of the filter as shown in FIG. 6(*b*), the distance (d) between the centers of two adjacent blocking members is substantially constant. For the purpose of using the filter of the present invention most effectively and for manufacturing it most efficiently, the distance (d) is preferably set at a value generally equal to the length (l) of a single filter divided by the number (n) of the grooves formed around the filter.

If the blocking members are too long, the advantages of the filter of the present invention may be lost, so their length is usually in the range of about 1 to 5 mm. Preferably, one blocking member is provided in one groove along the effective length of one filter. Two or more blocking members may be provided, but the more blocking members provided on the tape-like material, the smaller the ventilation effect of the filter will be attained.

Figure 3:
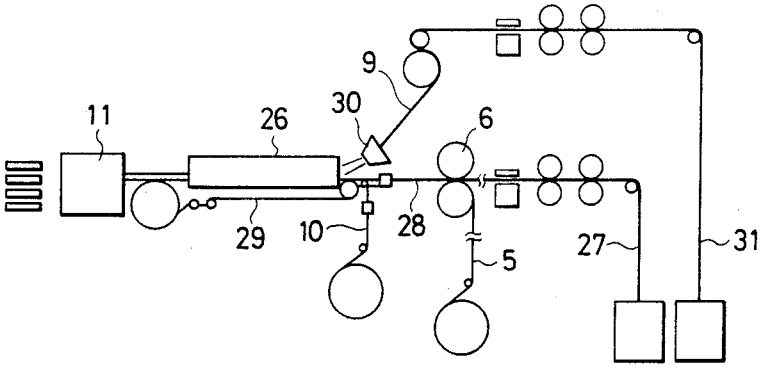
FIG. 3 is a schematic illustration of a filter plug making machine.
Figure 7:
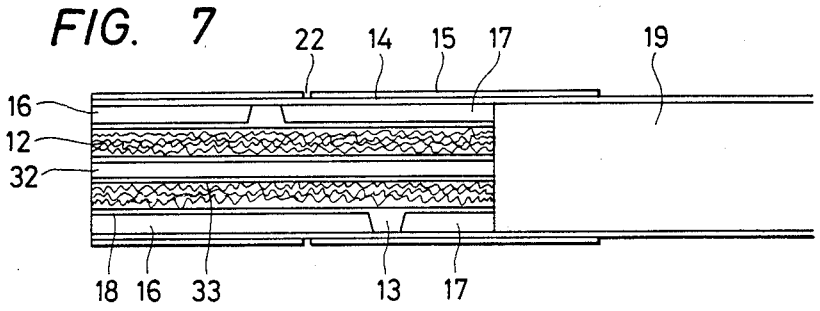
FIGS. 7 to 12 are cross sections showing other embodiments of the tobacco smoke filter of the present invention.
Figure 8:
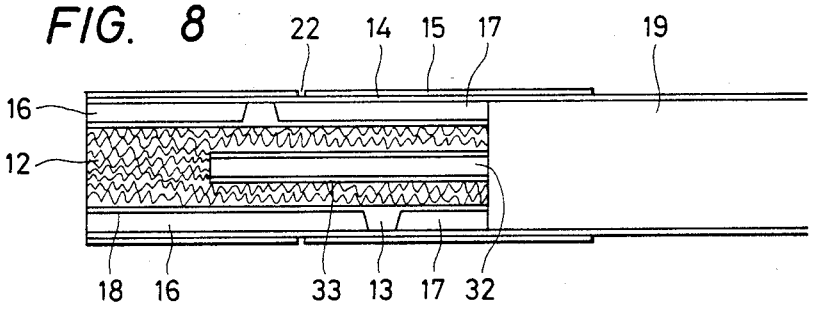
Figure 9:
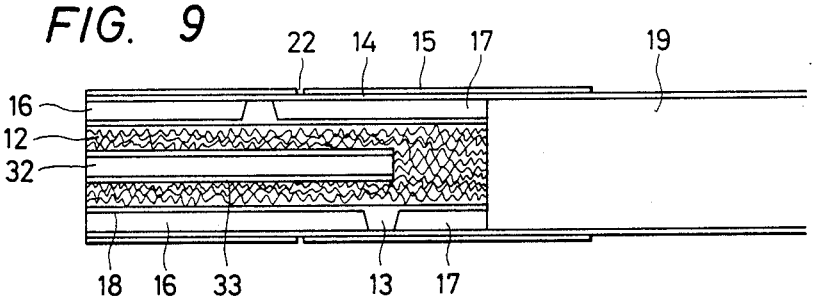
Figure 10:
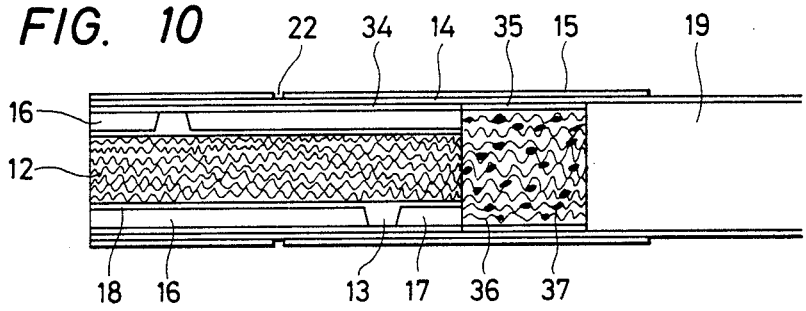
Figure 11:
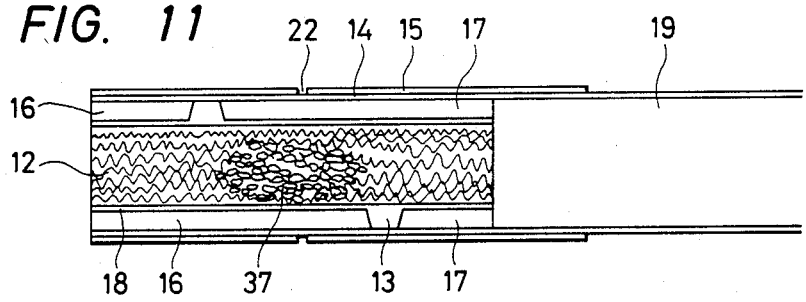
Figure 12:
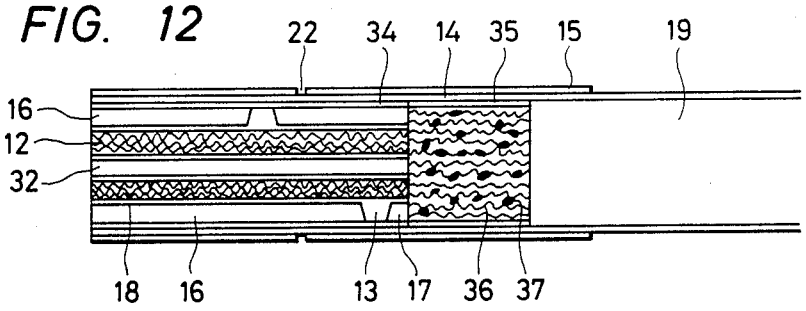

The tobacco smoke filter of the present invention is produced from a corrugated tape having the structure described above by such a type of a filter plug making machine as shown in FIG. 3. The corrugated tape indicated at (28) is wrapped around the filter core (9). After optionally wrapping a sheet of air-permeable paper (10), the assembly is fed to a cutter (11) where it is divided into a plurality of filters of a given length. Whatever cutting method is used, the filters each have grooves (16) substantially effective for ventilation purposes and grooves (17) substantially ineffective for the same purpose, and filters having grooves distributed in given proportions can be manufactured consistently by the above-described method. This consistency is a great advantage in that it avoids the possibility of making filters having variations in quality.

In the practice of the present invention, the filter core may be prepared from a tow or nonwoven fabric of cellulose acetate, polypropylene or other fibrous materials. The corrugated tape may be prepared from a film, tape or nonwoven fabric of polyester, polyethylene, polypropylene or cellulose acetate, or paper or metal foil. Fibrous materials may be "opened", and then applied with a plasticizer or adhesive, and shaped into a tape or sheet. For achieving maximum effect, the air permeability of the material for the corrugated tape should not be too great.

The tape-like material is given grooves most efficiently by passing it between corrugation rolls having an embossed pattern for providing blocking members. Alternatively, grooves may be formed with rolls having no embossed pattern for blocking members, and thereafter, selected parts of the grooves may be filled with blocking members. The corrugated tape may be formed off-line, or on-line as illustrated in FIG. 3.

The air-permeable paper used in preparing the filter of the present invention may be made of any material that permits atmospheric air to be taken into the grooves (16) during smoking. The paper may be an air-permeable one having an air permeability of about 10,000 ml/min.cm$^2$.10 cm $H_2O$. Paper having perforations as shown at (22) in FIG. 4 may also be used. The two types of paper may be used either individually or in combination.

An embodiment of the process for producing the tobacco smoke filter of the present invention is shown in FIG. 3. A fibrous filter core material (9) in a completely "open" state is applied with a plasticizer such as triacetin and fed to the filter plug making machine (26). A corrugated tape (5) is also fed to the plug making machine where it is wrapped around the filter core. At the same time, a sheet of air-permeable paper (10) is fed to the plug making machine, where one side seam of the paper is coated with an adhesive, the paper is wrapped around the corrugated tape, both side seams are joined, and the resulting plug is supplied into a cutter (11) where it is divided into a plurality of filter tips of a given length.

The tobacco smoke filter of the present invention offers small inhalation drag and the feeling of ample smoke inhalation for the smoker, and yet the filter is highly effective in reducing the amount of both particulate and gaseous vapor components in the smoke being taken into the mouth.

The present invention will be hereunder described in greater detail by reference to examples which are given here for illustrative purposes only and are by no means intended to limit the scope of the invention.

EXAMPLE 1 a. Production of Tobacco Smoke Filter (A)

A tow of crimped cellulose diacetate filaments (fineness of individual filaments: 1.7 deniers, total denier: 40,000 deniers, cross section of each filament: Y-shape) was supplied as a filter core material (indicated by (9) in FIG. 3). Another tow of crimped cellulose diacetate filaments (fineness of individual filaments: 3.3 deniers, total denier: 30,000 deniers, cross section of each filament: Y-shape) was supplied as (27) in FIG. 3, and after being applied with a plasticizer, it was passed between corrugation rolls (6) to provide 23 grooves at 145° C. (width: 23 mm, depth: 0.5 mm, the distance between the centers of two adjacent grooves: 1 mm, length of blocking members: 2 mm) to form a corrugated tape wherein the blocking members were distributed substantially uniformly in the plane as shown in FIG. 6(*a*) and wherein the distance (d) between the centers of two adjacent blocking members was about 1.087 mm as shown in FIG. 6(*b*). The so corrugated tape was fed to a filter plug making machine (26), wherein it was wrapped with a sheet of air-permeable paper (air permeability: 30,000 ml/min.cm$^2$.10 cm $H_2O$). Both side seams of the air-permeable paper were glued with an adhesive. The resulting filter plug was cut into a plurality of tobacco smoke filter samples (A).

b. Production of Tobacco Smoke Filter (B)

A tow of crimped cellulose diacetate filaments (fineness of individual filaments: 4 deniers, total denier: 43,000 deniers, cross section of each filament: Y-shape) was used as a filter core material. A sheet of paper comprising 40% polyethylene fibers and 60% wood pulp (basis weight: 73 g/m$^2$, thickness: 0.13 mm) was passed between the corrugation rolls to form a corrugated tape at 120° C. No plasticizer was incorporated in the tape. The tape was wrapped with a sheet of air-permeable paper (air permeability: 30,000 ml/min.cm$^2$.10 cm $H_2O$) and subsequently processed as in (a) to provide tobacco smoke filter samples (B).

c. Production of Tobacco Smoke Filters (C) and (D)

Tobacco smoke filter samples (C) were prepared using as a filter core material, a tow of crimped cellulose diacetate filaments of the same type as used in (a). In preparing these samples, nothing was passed between the corrugation rolls (no corrugated tape was formed). The outermost layer was made of a sheet of air-permeable paper (air permeability: 10,000 ml/min.cm$^2$.10 cm $H_2O$).

Tobacco smoke filter samples (d) were used as a filter core material, a tow of crimped cellulose diacetate filaments of the same type as used in (b). In preparing these samples, nothing was passed between the corrugation rolls (no corrugated tape was formed). The outermost layer was made of a sheet of air-permeable paper (air permeability: 10,000 ml/min.cm$^2$.10 cm $H_2O$).

d. Production of Tobacco Smoke Filter (E)

Tobacco smoke filter samples (E) were prepared as in (a) except that a polypropylene tube (ID: 1.00 mm) was inserted into the center of the fibrous filter material.

e. Production of Tobacco Smoke Filter (F)

Tobacco smoke filter samples (F) were prepared by inserting a polypropylene tube (ID: 1.00 mm, length: 15 mm) into the center of each of the samples (A) cut to filter tips 25 mm long.

f. Production of Tobacco Smoke Filter (G)

The samples (A) cut to filter tips 25 mm long were connected to 7 mm long tips of charcoal filters from Japanese "Mild Seven" brand cigarettes, and each assembly was wrapped with a sheet of air-permeable paper (air permeability: 30,000 ml/min.cm$^2$.10 cm $H_2O$) to make a tobacco smoke filter sample (G) with a dual structure.

g. Production of Tobacco Smoke Filter (H)

The samples (E) cut to filter tips 25 mm long were connected to 10 mm long tips of charcoal filters from "Mild Seven" brand cigarrettes, and each assembly was wrapped with a sheet of air-permeable paper (air permeability: 30,000 ml/min.cm$^2$.10 cm $H_2O$) to make a tobacco filter sample (H) with a dual structure.

Ten types of filter-tipped cigarettes were prepared by connecting smoke filter samples (A) to (H) to tobacco cylinders with the papers indicated in Table 1 below. The tobacco cylinders were obtained by removing filters from cigarettes sold in Japan under the brand name "Hi-lite". Samples of Lot Nos. 7 to 10 had the structure illustrated in FIGS. 8, 9, 10 and 12, respectively.

The ten types of filter-tipped cigarettes were smoked by a constant flow type automatic smoking machine under the following conditions: flow rate=17.5 ml/sec, smoking time=2 seconds, smoking interval=58 seconds, burnt cigarette length=50 mm. The individual samples were analyzed for the amounts of TPM, tar and nicotine trapped in the tobacco smoke filters and Cambridge filters, and the results are shown in Table 1 below.

The air permeability of the outermost layer was evaluated in terms of the amount of air passing through 1 cm$^2$ of the layer per minute at a differential pressure of 100 mm $H_2O$ across the layer. The air passage drag was measured in terms of pressure loss in mm $H_2O$ when 17.5 ml/sec of air was caused to pass through the tobacco smoke filter or one filter-tipped cigarette. The ventilation effect was indicated in terms of 100 times the amount of air flowing into the filter through perforations in the tip, divided by the total amount of air inhaled.

TABLE 1

| Lot No. | Tobacco Smoke Filter Type | Tobacco Smoke Filter Length (mm) | Connecting Paper | PD (mm $H_2O$) | TPD (mm $H_2O$) | Smoke Removal by Filter TPM (%) | Smoke Removal by Filter Tar (%) | Smoke Removal by Filter Nicotine (%) | Smoke Passing through Filter (mg per filter) TPM | Smoke Passing through Filter (mg per filter) Tar | Smoke Passing through Filter (mg per filter) Nicotine | Ventilation Effect (%) |
|---|---|---|---|---|---|---|---|---|---|---|---|---|
| 1 | (A) | 25 | perforations in 8 rows | 34 | 38 | 71.8 | 64.6 | 74.3 | 1.47 | 1.34 | 0.09 | 81 |
| 2 | (B) | 25 | perforations in 8 rows | 14 | 18 | 86.8 | 86.3 | 63.7 | 0.87 | 0.81 | 0.06 | 87 |
| 3 | (C) | 25 | ordinary paper | 148 | 214 | 72.3 | 65.7 | 58.9 | 12.5 | 10.6 | 0.79 | 0 |

TABLE 1-continued

| Lot No. | Tobacco Smoke Filter Type | Length (mm) | Connecting Paper | PD (mm $H_2O$) | TPD (mm $H_2O$) | Smoke Removal by Filter TPM (%) | Tar (%) | Nicotine (%) | Smoke Passing through Filter (mg per filter) TPM | Tar | Nicotine | Ventilation Effect (%) |
|---|---|---|---|---|---|---|---|---|---|---|---|---|
| 4 | (D) | 20 | ordinary paper | 60 | 122 | 48.4 | 42.6 | 33.8 | 24.4 | 18.9 | 1.41 | 0 |
| 5 | (C) | 25 | perforations in 8 rows | 93 | 98 | 85.8 | 86.6 | 76.7 | 1.18 | 0.96 | 0.09 | 81 |
| 6 | (E) | 25 | perforations in 8 rows | 22 | 30 | 20.0 | 19.7 | 10.1 | 6.95 | 5.10 | 0.57 | 75 |
| 7 | (F) | 25 | perforations in 8 rows | 33 | 38 | 72.4 | 69.7 | 66.0 | 1.78 | 1.62 | 0.14 | 80 |
| 8 | (F) | 25 | perforations in 8 rows | 31 | 35 | 69.4 | 67.4 | 61.5 | 1.75 | 1.55 | 0.14 | 81 |
| 9 | (G) | 32 | perforations in 5 rows | 38 | 40 | 76.2 | 75.3 | 73.4 | 1.64 | 1.46 | 0.10 | 80 |
| 10 | (H) | 35 | perforations in 8 rows | 30 | 31 | 68.3 | 69.5 | 46.9 | 1.65 | 1.50 | 0.14 | 83 |

PD: Air passage drag of filters with connecting paper.
TPD: Total air passage drag of filter plus tobacco cylinder.

What is claimed is:

1. A tobacco smoke filter, comprising; a core comprising a fibrous filter material wrapped with substantially one turn of a corrugated tape-like material, said tape-like material being further wrapped with air-permeable means, said air permeable means cooperating with said tape-like material to jointly define grooves extending in the axial direction of the filter, each groove having at least one blocking member positioned in the longitudinal direction of the filter in a manner such that the blocking member in one groove is staggered with respect to those in adjacent grooves.

2. A tobacco smoke filter according to claim 1, wherein the distance between the centers of two adjacent blocking members as projected onto a plane is substantially equal to the length of said filter divided by the number of the grooves formed around the filter.

3. A tobacco smoke filter according to claim 2, further including a tubular member penetrating the center of the filter in the longitudinal direction thereof.

4. A tobacco smoke filter according to claim 2, further including a tubular member partially penetrating the center of the filter in the longitudinal direction thereof.

5. A tobacco smoke filter according to claim 1, wherein said air-permeable means comprises a sheet of air-permeable paper and a sheet of perforated connecting paper.

6. A tobacco smoke filter according to claim 1, wherein said air-permeable means comprises a sheet of air-permeable paper.

7. A tobacco smoke filter according to claim 1, wherein said air-permeable means comprises a sheet of perforated connecting paper.

8. A tobacco smoke filter having a dual structure consisting of a first filter positioned closer to the smoker's mouth and a second filter positioned on the side to be connected to the tobacco cylinder, said first filter comprising a core comprising a fibrous filter material wrapped with substantially one turn of a corrugated tape-like material, said tape-like material being further wrapped with air-permeable means cooperating with the tape-like material to jointly define grooves extending in the axial direction of the filter, each groove having at least one blocking member positioned in the longitudinal direction of the filter in a manner such that the blocking member in one groove is staggered with respect to that in adjacent grooves, said second filter comprising a fibrous filter material.

9. A tobacco smoke filter according to claim 8, wherein the distance between the centers of two adjacent blocking members as projected onto a plane is substantially equal to the quotient of said length divided by the number of the groove formed around the filter.

10. A tobacco smoke filter according to claim 8, wherein said second filter includes an additive.

11. A tobacco smoke filter according to claim 8, and further including a tubular member penetrating the center of the filter in the longitudinal direction thereof, said second filter comprising a fibrous filter material filled with an additive.

12. A tobacco smoke filter according to claim 8, wherein said air-permeable means comprises a sheet of air-permeable paper and a sheet of perforated connecting paper.

13. A tobacco smoke filter according to claim 8, wherein said air-permeable means comprises a sheet of air-permeable paper.

14. A tobacco smoke filter according to claim 8, wherein said air-permeable means comprises a sheet of perforated connecting paper.

15. A tobacco smoke filter, comprising; a solid additive center surrounded by a fibrous filter material wrapped with substantially one turn of a corrugated tape-like material, said tape-like material being further wrapped with air-permeable means cooperating with the tape-like material to jointly define grooves extending in the axial direction of the filter, each groove having at least one blocking member positioned in the longitudinal direction of the filter in a manner such that the blocking member in one groove is staggered with respect to that in adjacent grooves.

16. A tobacco smoke filter according to claim 15, wherein the distance between the centers of two adjacent blocking members as projected onto a plane is substantially equal to the length of said filter divided by the number of the grooves formed around the filter.

17. A tobacco smoke filter according to claim 15, wherein said air-permeable means comprises a sheet of air-permeable paper and a sheet of perforated connecting paper.

18. A tobacco smoke filter according to claim 15, wherein said air-permeable means comprises a sheet of air-permeable paper.

19. A tobacco smoke filter according to claim 15, wherein said air-permeable means comprises a sheet of perforated connecting paper.

20. A process of producing a tobacco smoke filter which includes a core made of a fibrous filter material wrapped with substantially one turn of a corrugated tape-like material, which is in turn further wrapped with air-permeable paper means cooperating with the tape-like material to jointly define therebetween grooves extending in the axial direction of the filter; including the steps of supplying the fibrous filter material, providing each of the grooves in the tape-like material with at least one blocking member in the longitudinal direction of the filter within a distance equal to the length of one filter, in a manner such that the blocking member in one groove is staggered with respect to that in adjacent grooves, wrapping said tape-like material about said fibrous material, and surrounding said tape-like material with at least one of an air-permeable paper and a perforated connecting paper.

21. A process according to claim 20, including the step of simultaneously corrugating the tape-like material and providing the same with said blocking members.

* * * * *